United States Patent [19]

Turek

[11] Patent Number: 4,934,700

[45] Date of Patent: Jun. 19, 1990

[54] DICE WORD GAME METHOD

[76] Inventor: Alice N. Turek, 7887 N. La Cholla Blvd. #1113, Tucson, Ariz. 85741

[21] Appl. No.: 290,528

[22] Filed: Dec. 27, 1988

[51] Int. Cl.[5] ..... A63F 9/04

[52] U.S. Cl. ..... 273/146

[58] Field of Search ..... 273/146

[56] References Cited

U.S. PATENT DOCUMENTS

| | | | |
|---|---|---|---|
| 1,412,204 | 4/1922 | Derby | 273/146 X |
| 1,524,529 | 1/1925 | Allen . | |
| 1,538,455 | 5/1925 | Winkel . | |
| 1,557,352 | 10/1925 | Fox | 273/146 |
| 1,584,316 | 5/1926 | Mayhew . | |
| 1,984,609 | 9/1928 | Walker . | |

FOREIGN PATENT DOCUMENTS

| | | | |
|---|---|---|---|
| 2116051 | 9/1983 | United Kingdom | 273/146 |

*Primary Examiner*—Anton O. Oechsle

*Attorney, Agent, or Firm*—Victor Flores; Harry M. Weiss

[57] ABSTRACT

This invention discloses a dice word game set of twenty-four identical six-sided dice. Each side of each die is marked with a unique letter of a six-letter target word, so that the die contains all letters in the target word, which in the preferred embodiment is the word "HEARTS". Each player is given six dice, one for each letter in the target word. The player rolls one die, attempting to roll the first letter in the target word. If the roll is successful, the die is added to a completion set, which partially spells the target word, and the player attempts to roll the next letter in the target word. When a player has completed spelling the target word, he wins the game. Because the dice are identical, the game set is inexpensive to produce. Because the target word is given and known, the game is easy to play, requires a minimum of mental exercise, and is relaxing. Because the dice are rolled one at a time, the odds of winning are sufficiently great to make the game interesting to play.

2 Claims, 3 Drawing Sheets

DICE WORD GAME METHOD

FIELD OF THE INVENTION

The present invention relates to a word game apparatus. More particularly, the present invention relates to a word game apparatus and method whereby players may spell a particular word by rolling a game piece marked with the letters of that word.

DESCRIPTION OF THE PRIOR ART

Games of chance may provide people with simple and relaxing entertainment, requiring little or no mental efforts or skill on the part of the participants. Such games may be particularly enjoyable when the chances of winning are high enough that the player wins before he becomes bored with the game. The relatively random result achieved by throwing dice or similar geometrical game pieces provides a method of playing a game of chance, as the skill or thoughts of the thrower have little to do with the outcome produced. Dice game sets have the added advantage that they may be produced at a very small cost.

The sides of a dice set, though typically marked with numbers of spots, may be marked with letters of the alphabet in order to alter the nature of the game to be played. Several prior inventions have disclosed dice marked with letters, including those of U.S. Pat. No. 1,524,529 to L.J. Allen, U.S. Pat. No. 1,584,316 to R. Mayhew, and U.S. Pat. No. 1,684,609 to W.D. Walker.

The '529 and '316 inventions disclose sets of dice wherein each die is marked with different letters than the other dice in the set. However, their dice are used in games requiring not only luck but also some degree of mental efforts and skill. The dice are thrown, and the player must attempt to form the top letters into words. This may not always be possible, and may in any case be difficult and not very relaxing. The '609 invention removes the elements of skill and effort from the game, but at a cost of dramatically decreased odds of winning. Each face of each die is marked so as to be combinable with only one particular face on each of the remaining die, with the result that a throw of all the dice will result in a win after an average of (n raised to the n−1 power)/2 rolls, n being the number of dice thrown. For a game of six dice, this equals odds of 1:46,646. All of the above named inventions also have the added disadvantage of a somewhat increased cost of production, due to their non-identical dice.

Therefore, a need exists for a dice word game apparatus and method of playing which require a minimum of skill so that playing the game is relaxing, which have good odds of winning so that playing the game is interesting, and which have identical dice so that the apparatus may be produced at minimum cost.

SUMMARY OF THE INVENTION

Therefore, the objects of this invention are to provide a dice word game method of playing which requires a minimum of skill, which has good odds of winning, and which uses identical dice.

The apparatus for practicing the method of the present invention embodies a game whereby dice are rolled to produce a given word associated with the particular apparatus. Several different embodiments of the method of playing the game of the apparatus are possible, but in each embodiment, each letter of the word is obtained by rolling a single die. In one embodiment of the method, the letters of the word may be rolled in any order, but in the preferred embodiment, the letters must be rolled in the order they appear in the word. Because the word is spelled rolling only one die at a time, the average number of rolls which are required to spell the word is reduced to roughly n times n/2, n being the number of dice. For a game of six dice, this equals winning odds of 1:21, a quite notable improvement in odds over the prior art. This improvement is due to the letters of the word being rolled in series, rather than in parallel, or all at once.

The apparatus, too, may have many possible embodiments. For example, the apparatus for practicing the method may be constructed for spelling words of various lengths. In the best mode contemplated, however, the apparatus is constructed to spell a six-letter word. Obviously, many different six-letter words are possible, but in the best mode contemplated, the word is "HEARTS". Because the word to be spelled is known and is the same at each playing, the game requires a minimum of skill and is relaxing to play.

The game pieces of the apparatus for practicing the method may be of various shapes, such as eight-, ten-, or twelve-sided blocks, but in the best mode contemplated, they are six-sided dice. The letters of the word may be distributed in various manners about the game pieces. For example, each letter may appear on only one die, or may appear on each die, or even on more than one side of each die. But, in the best mode contemplated, each letter appears on exactly one side of each die. Hence, all the dice are identical. The apparatus may be constructed of various combinations of game pieces, and may even consist of a single game piece, but in the best mode contemplated, each player is provided with one game piece for each letter of the word, so that the game pieces may be used to keep score, as contemplated in the best mode of the method.

Finally, different embodiments of the apparatus for practicing the method may provide playing pieces for different numbers of players, but in the best mode contemplated, there are four groups of six identical six-sided dice, or twenty-four identical dice. Because the dice are identical, they may all be produced from the same mold or other device, and the cost of producing the game set is minimized.

Therefore, to the accomplishments of the foregoing objects, the invention consists of the foregoing features hereinafter fully described and particularly pointed out in the claims, the accompanying drawings and following disclosure describing in detail the invention, such drawings and disclosure illustrating, however, but one of the various ways in which the invention may be practiced.

DESCRIPTION OF THE PREFERRED EMBODIMENT

Figure 1:
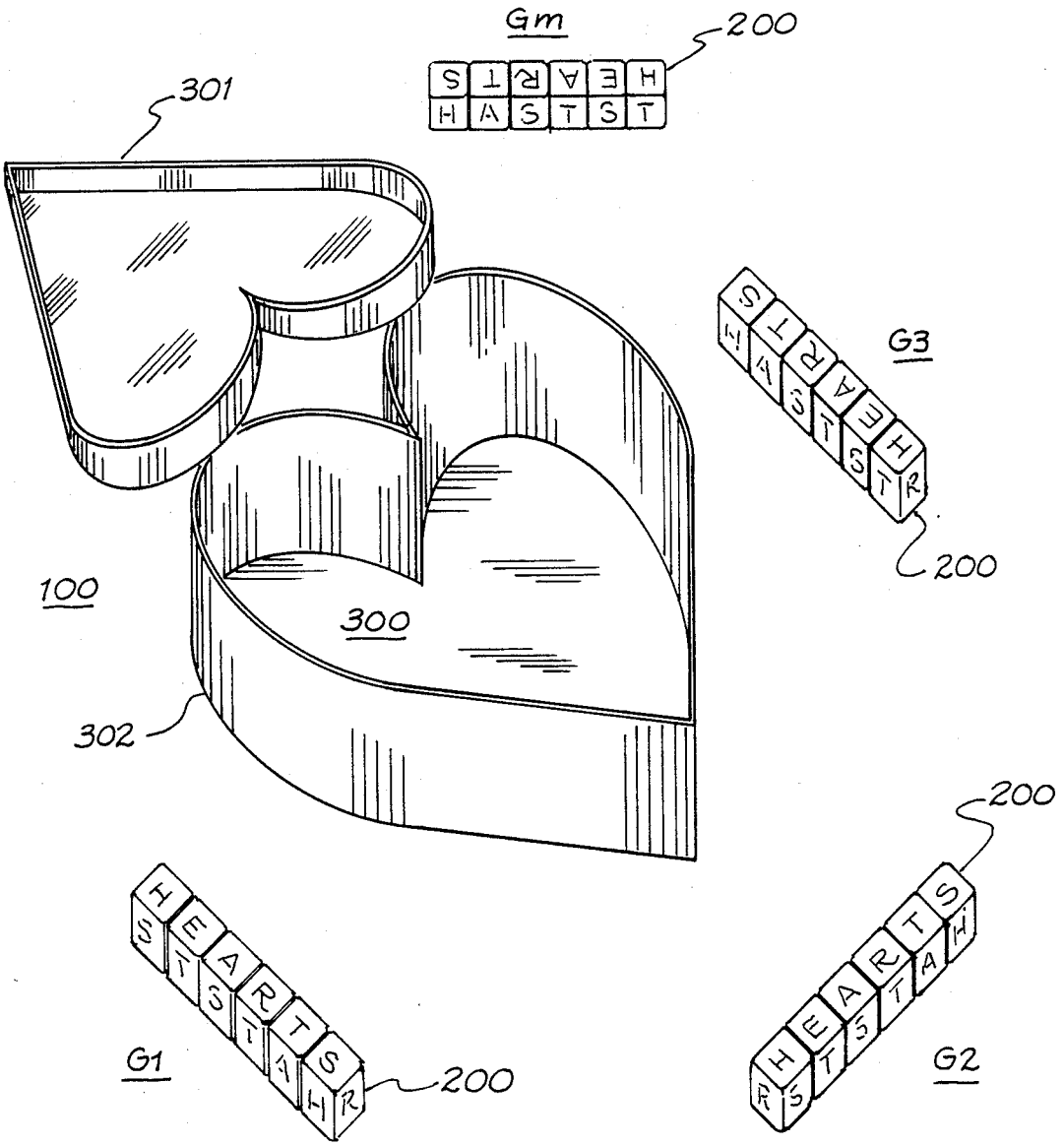
FIG. 1 is a top view of one embodiment of the word game set of the present invention, illustrating a heart-shaped packaging container and four groups of game pieces to be given individual players.

The present invention discloses a word game set 100, shown in FIG. 1, for playing a dice word game. The word game set 100 includes a plurality of game pieces 200, which come in a container 300 with a lid 301. In the best mode contemplated, the game pieces 200 are six-sided dice, and the container 300 and lid 301 are heart-shaped. The plurality of game pieces 200 consists of, and is shown arranged in, a number of groups Gl–Gm. The game pieces 200 are used to spell a given word associated with the word game set 100. In the best mode contemplated, the word is "HEARTS", and FIG. 1 shows each die adapted with the letters of that word.

Figure 2:
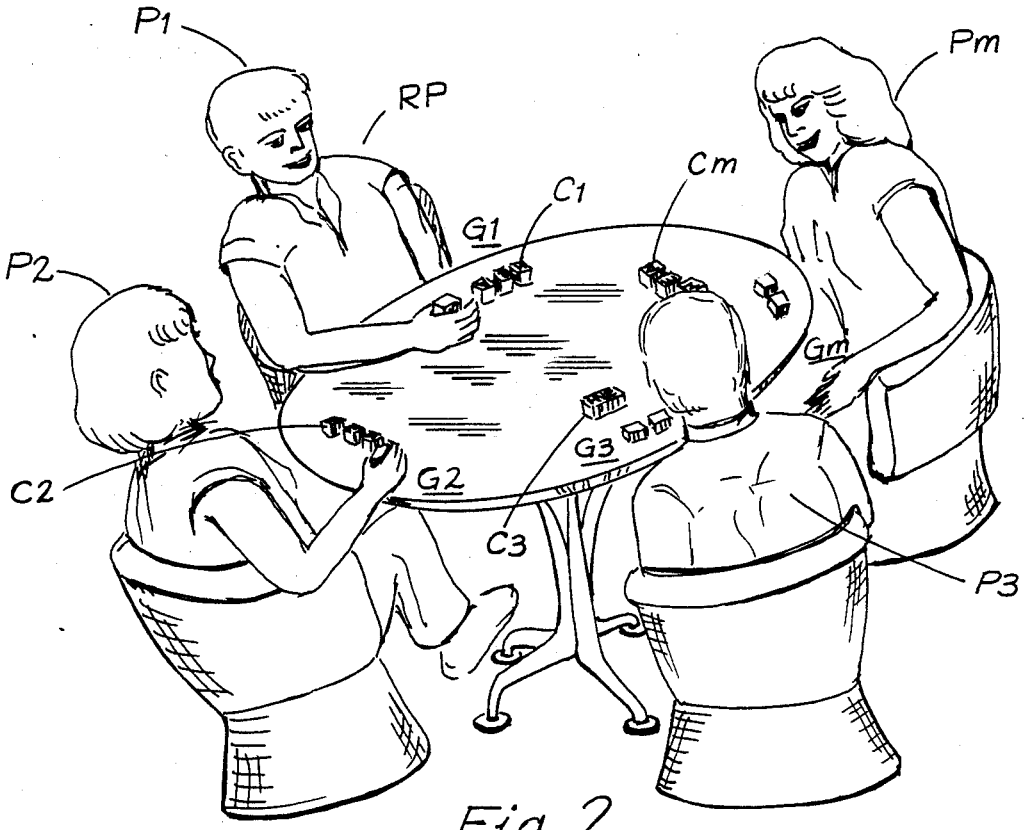
FIG. 2 is a perspective view of the word game set of the present invention being played by four players, wherein each player has the word "HEARTS" at an incomplete stage of being spelled.

FIG. 2 shows a group of players Pl–Pm playing the dice word game. Each player Pl–Pm has a respective group Gl–Gm of playing pieces, shown in various stages of progression in the game. Player Pl is shown rolling one of the playing pieces 200 in his group Gl. Player Pl is also shown as the rolling player RP, or in other words, it is his turn to play.

Figure 3:
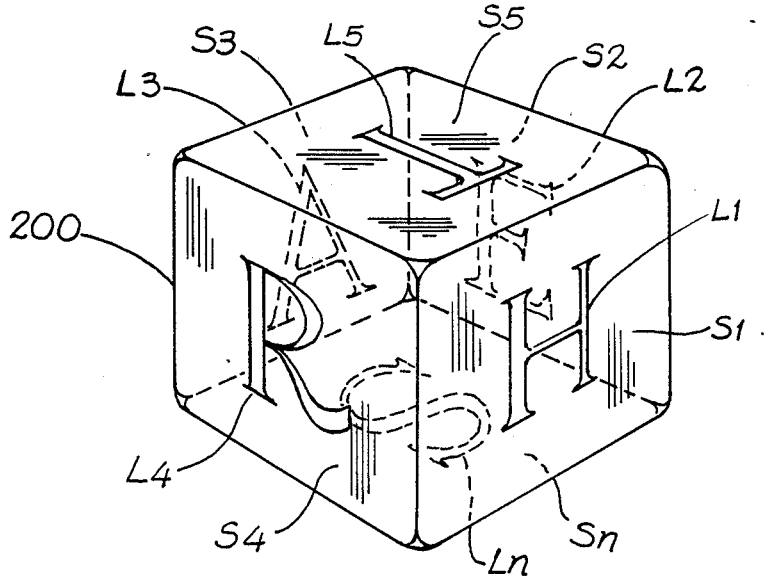
FIG. 3 is a perspective view of an enlarged game piece with each face of the game piece provided with a letter of the word "HEARTS". The game piece is shown as though transparent, for purposes of illustration.
Figure 4:
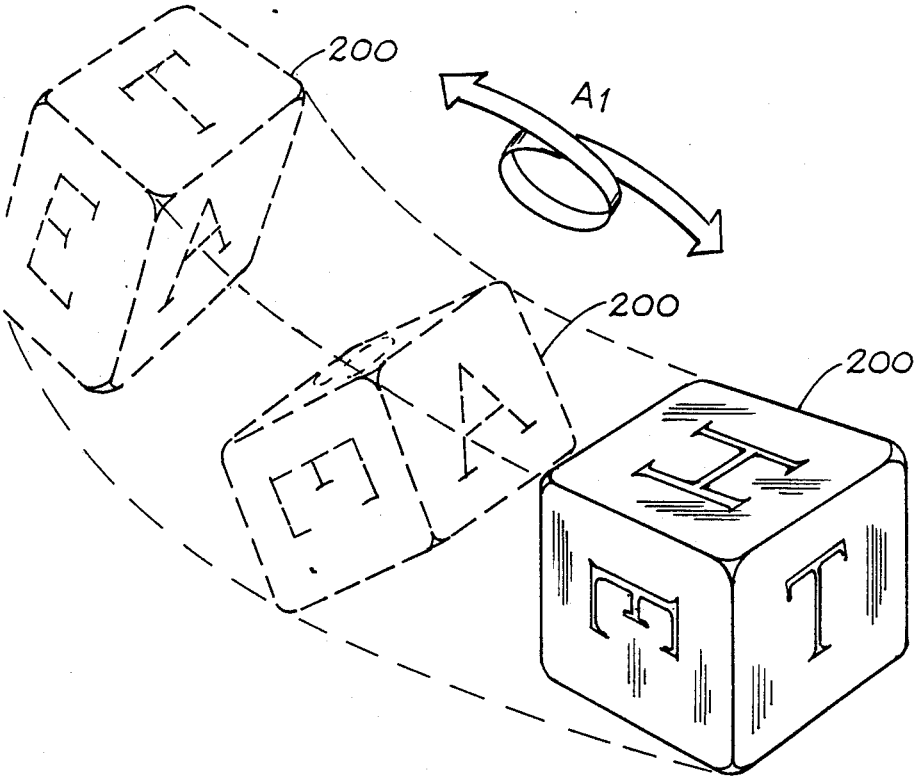
FIG. 4 is a perspective view of a game piece being rolled to land with the letter "H" facing up, to illustrate the first letter of a sequence to be used in spelling the word "HEARTS".

To play, the current rolling player RP rolls one of his or her playing pieces 200 from his or her group Gl–Gm, with motion Al, as shown in FIG. 4. A playing piece 200 is shown in detail in FIG. 3. Although the playing piece 200 may be constructed as a geometric figure with an arbitrary number of sides, in the best mode contemplated each playing piece 200 is a six-sided die, and is shown in FIG. 3 as such for ease of illustration. Each side Sl–Sn of the playing piece 200 has a letter mark Ll–Ln on its surface, signifying the particular letters of the word to be spelled with the game set 100. The playing piece 200 may be used to roll any one of the letters in the word. Although not shown, the letters on the playing pieces 200 may be modified to spell another word, using letter labels which may be adhesively applied.

The object of the game is to sequentially roll all the letters of a target word. In the best mode contemplated, the target word is the word "HEARTS", so the letter marks Ll–Ln are the letters "H", "E", "A", "R", "T", and "S", respectively, as shown in FIG. 3. Referring again to FIG. 2, each player Pl–Pm starts out the game with an empty completion set Cl–Cm. Player P3's completion set C3 is shown, with two dice with the letters "H" and "E" face up indicating the stage of spelling the word "HEARTS". As each player Pl–Pm gets a turn to be the rolling player RP, he or she rolls a playing piece 200 from his or her group Gl–Gm. If the playing piece 200 comes to rest with the first letter Ll facing upward, the player Pl–Pm adds that playing piece 200 to his or her completion set Cl–Cm, leaving the playing piece 200 with the same letter Ll facing upward. Player Pl's completion set Cl is shown with the first three letters, "H", "E" and "A", having been rolled and added to the completion set Cl.

Figure 5:
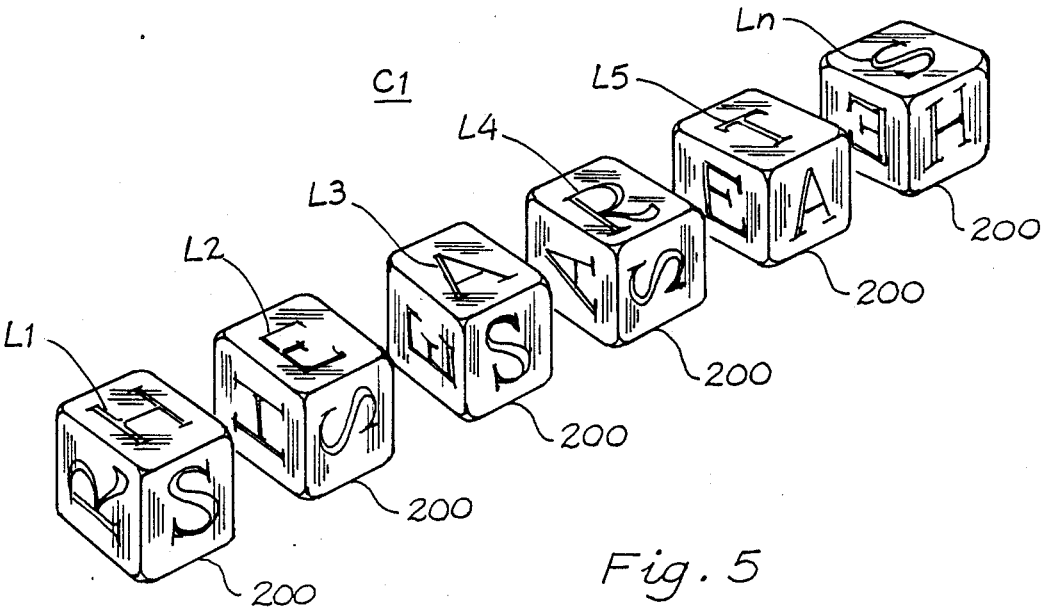
FIG. 5 is a perspective view of one player's group of game pieces in the winning configuration, spelling the word "HEARTS", after the player has successfully rolled each of the letters of the word in a specified manner.

If the rolling player RP fails to roll the first letter Ll, a new rolling player RP is chosen. However, if the rolling player RP successfully rolls the first letter Ll, then he or she remains the rolling player, and attempts to roll the next letter L2 in the target word. Play continues around the group of players Pl–Pm in this manner, until one player Pl–Pm successfully rolls all letters Ll–Ln in the target word, adding each playing piece 200 in his or her group Gl–Gm to his or her completion set Cl–Cm. FIG. 5 illustrates completion set Cl in its final state of completion, with all letters Ll–Ln in place. The word "HEARTS" has been spelled, and player Pl has won the game.

Therefore, while the present invention has been shown and described herein in what is believed to be the most practical and preferred embodiments, it is recognized that departures can be made therefrom within the scope of the invention, which is therefore not to be limited to the details disclosed herein but is to be accorded the full scope of the claims so as to embrace any and all equivalent apparatus.

I claim:

1. A method of playing a word game, comprising the steps of:

(a) providing a word game apparatus comprising:
  (i) a plurality of playing pieces, each playing piece of said plurality comprising a multi-sided, three-dimensional, geometric object; and
  (ii) a plurality of mark means provided on each said object for spelling a target word, said target word having a number of letters equal to said plurality of mark means;
(b) establishing rules for initializing, scoring, and winning said word game;
(c) determining a first quantity of said playing pieces each player will play;
(d) determining a second quantity of playing pieces that will be equally divided among the players;
(e) distributing said determined first quantity of game pieces to each player of a plurality of players;
(f) rolling a one of said first quantity of game pieces held by a player;
(g) reading a top side of said rolled game piece to see if a first letter of said target word to be spelled has been rolled;
(h) allowing another player to roll if said first letter was not rolled by said player;
(i) placing a one of said first quantity in a cumulative word score arrangement if said first letter was rolled by said player;
(j) continuing said rolling, reading, allowing, and placing steps until said target word has been spelled and said first quantity of game pieces have been played by a player.

2. The method of claim 1 wherein:

said target word comprises having six unique letters spelling the word "HEARTS";

said each playing piece comprises a cubical die having six sides;

said first quantity comprises a number six; and said second quantity comprises a number twenty-four.

* * * * *